US008110979B2

(12) United States Patent
Park et al.

(10) Patent No.: US 8,110,979 B2
(45) Date of Patent: Feb. 7, 2012

(54) INORGANIC ELECTROLUMINESCENCE DEVICE, DISPLAY APPARATUS HAVING THE SAME AND METHOD THEREOF

(75) Inventors: Shang-hyeun Park, Yongin-si (KR); Ji-beom Yoo, Suwon-si (KR); Mun-Ja Kim, Suwon-si (KR); Min-jong Bae, Yongin-si (KR); Tae-won Jeong, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 188 days.

(21) Appl. No.: 12/611,538

(22) Filed: Nov. 3, 2009

(65) Prior Publication Data

US 2010/0244663 A1 Sep. 30, 2010

(30) Foreign Application Priority Data

Mar. 25, 2009 (KR) ..... 10-2009-0025546

(51) Int. Cl.

| | |
|---|---|
| ***H01J 1/62*** | (2006.01) |
| ***H01J 63/04*** | (2006.01) |
| ***H01J 9/00*** | (2006.01) |

(52) U.S. Cl. ..... 313/502; 313/483; 313/500; 313/501; 313/503; 313/238; 445/24

(58) Field of Classification Search ..... None
See application file for complete search history.

(56) References Cited

U.S. PATENT DOCUMENTS

| | | | | |
|---|---|---|---|---|
| 7,675,230 | B2 * | 3/2010 | Kasama et al. | 313/506 |
| 2006/0257074 | A1 * | 11/2006 | Suzuki et al. | 385/49 |
| 2007/0045630 | A1 * | 3/2007 | Toyoda | 257/72 |
| 2010/0072890 | A1 * | 3/2010 | Bae et al. | 313/509 |

FOREIGN PATENT DOCUMENTS

| | | | |
|---|---|---|---|
| JP | 11233254 | A | 8/1999 |
| JP | 2007287333 | A | 11/2007 |
| KR | 1020050031961 | A | 4/2005 |
| KR | 1020060029186 | A | 4/2006 |
| KR | 1020070022603 | A | 2/2007 |

* cited by examiner

*Primary Examiner* — Natalie K Walford
(74) *Attorney, Agent, or Firm* — Cantor Colburn LLP

(57) ABSTRACT

An inorganic electroluminescence device including a first electrode and a second electrode disposed apart from each other, and a dielectric material layer disposed between the first and second electrodes. The dielectric material layer has a micro-tubular shape, and a light emitting layer is filled in the dielectric material layer.

19 Claims, 4 Drawing Sheets

INORGANIC ELECTROLUMINESCENCE DEVICE, DISPLAY APPARATUS HAVING THE SAME AND METHOD THEREOF

CROSS-REFERENCE TO RELATED APPLICATIONS

This application claims priority to Korean Patent Application No. 10-2009-0025546, filed on Mar. 25, 2009, and all the benefits accruing therefrom under 35 U.S.C. §119, the disclosure of which are incorporated herein in its entirety by reference.

BACKGROUND

1. Field

One or more embodiments relate to an inorganic electroluminescence device and a display apparatus having the same.

2. Description of the Related Art

Use of digital information displays ("DIDs") and home displays has increased considerably. In this regard, as inorganic electroluminescence devices may be made thin and flexible at low manufacturing costs, research has been conducted to use such devices in DIDs, home displays, and other devices.

Inorganic electroluminescence devices may be roughly classified into two types: a thin-film type and a distribution type. A thin-film type inorganic electroluminescence device has a structure in which a light emitting layer is formed between two dielectric material thin-films, and the light emitting layer is formed of a phosphor material. Since such a thin-film type inorganic electroluminescence device has definite threshold voltage, it may be used in a passive matrix ("PM") type display apparatus.

In contrast, a distribution type inorganic electroluminescence device has a light emitting layer with a structure in which phosphor particles are distributed within an insulative binder. Such a distribution type inorganic electroluminescence device has no definite threshold voltage. Thus, if a distribution type inorganic electroluminescence device is used in a PM type display apparatus, pixels which surround driven particular pixels that emit light, also emit light. In other words, cross-talk occurs.

Therefore, distribution type inorganic electroluminescence devices are generally used as lamp type light sources. For example, distribution type inorganic electroluminescence devices have been often used in keypads of cellular phones, advertisement panels, or simple medical equipment. Therefore, there is a need to increase the applicability of distribution type inorganic electroluminescence devices in display apparatuses.

SUMMARY

One or more embodiments include an inorganic electroluminescence device and a passive matrix type display apparatus having the same.

One or more exemplary embodiments includes an inorganic electroluminescence device including first and second electrodes disposed apart from each other, and a dielectric material layer disposed between the first and second electrodes. The dielectric material layer has a micro-tubular shape, and a light emitting layer is filled in the dielectric material layer.

The light emitting layer may include an insulative binder and phosphor particles distributed within the insulative binder. Each of the phosphor particles may have a diameter smaller than or equal to 1 micrometer (μm).

An outer diameter of the dielectric material layer may be from approximately 1 μm to approximately 10 μm, whereas an inner diameter of the dielectric material layer may be from approximately 0.3 μm to approximately 3 μm.

The dielectric material layer may be disposed parallel to either the first electrode or the second electrode. The first electrode may include a transparent conductive material, and the second electrode may include a metal.

One or more exemplary embodiments includes a display apparatus including a plurality of first electrodes disposed in parallel to each other, a plurality of second electrodes disposed to cross the first electrodes, where the second electrodes respectively correspond to the first electrodes, and a plurality of dielectric material layers disposed between the first electrode and the second electrode. Each of the dielectric material layers has a micro-tubular shape, and a plurality of light emitting layers are respectively filled in the dielectric material layers. Each of the light emitting layers includes phosphor particles of a color.

The dielectric material layers may be respectively disposed on the first electrodes and in parallel to the first electrodes. Alternatively, the dielectric material layers may be respectively disposed on the second electrodes and in parallel to the second electrodes.

The first electrodes and the second electrodes may cross each other perpendicularly.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
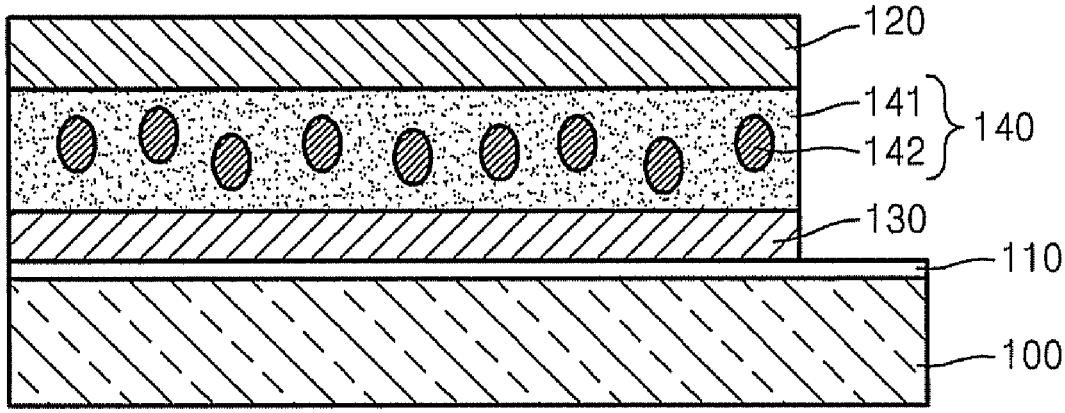
FIG. 1 (PRIOR ART)
FIG. 1 is a diagram showing a general structure of a conventional distribution type inorganic electroluminescence device.

Reference will now be made in detail to embodiments, examples of which are illustrated in the accompanying drawings, wherein like reference numerals refer to the like elements throughout. In this regard, the illustrated embodiments may have different forms and should not be construed as being limited to the descriptions set forth herein. Accordingly, the exemplary embodiments are merely described below, by referring to the figures, to explain aspects of the present description. In the drawings, the size and relative sizes of layers and regions may be exaggerated for clarity.

It will be understood that when an element or layer is referred to as being "on" another element or layer, the element or layer can be directly on another element or layer, or intervening elements or layers. In contrast, when an element is referred to as being "directly on" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the invention will be described in detail with reference to the accompanying drawings.

FIG. 1 is a diagram showing a general structure of a conventional distribution type inorganic electroluminescence device.

Referring to FIG. 1, a first electrode 110 is disposed on a substrate 100. The first electrode 110 may include a transparent conductive material, such as indium tin oxide ("ITO"). A dielectric material layer 130 is disposed on the first electrode 110, opposing the substrate 100 with respect to the first electrode 110. The dielectric material 130 has a first thickness taken in a direction substantially perpendicular to the substrate 100. The first thickness of the dielectric material layer 130 may be approximately 30 micrometers (μm), for example.

A light emitting layer 140 is disposed on the dielectric material layer 130 and has a second thickness taken in the direction substantially perpendicular to the substrate 100. The light emitting layer 140 includes an insulative binder 141, and phosphor particles 142 of a color that are distributed within the insulative layer 141. In one exemplary embodiment, the light emitting layer 140 may have the second thickness from approximately 50 μm to approximately 100 μm.

A second electrode 120 is disposed on the light emitting layer 140 and forms an uppermost layer of the conventional distribution type inorganic electroluminescence device illustrated in FIG. 1. The second electrode 120 may include a metal such as silver (Ag). Alternatively, the dielectric material layer 130 may be disposed between the second electrode 120 and the light emitting layer 140. Still alternatively, the dielectric material layer 130 may be disposed between the first electrode 110 and the light emitting layer 140, and between the second electrode 120 and the light emitting layer 140. However, such a conventional distribution type inorganic electroluminescence device as illustrated in FIG. 1, has no definite threshold voltage.

Figure 2:
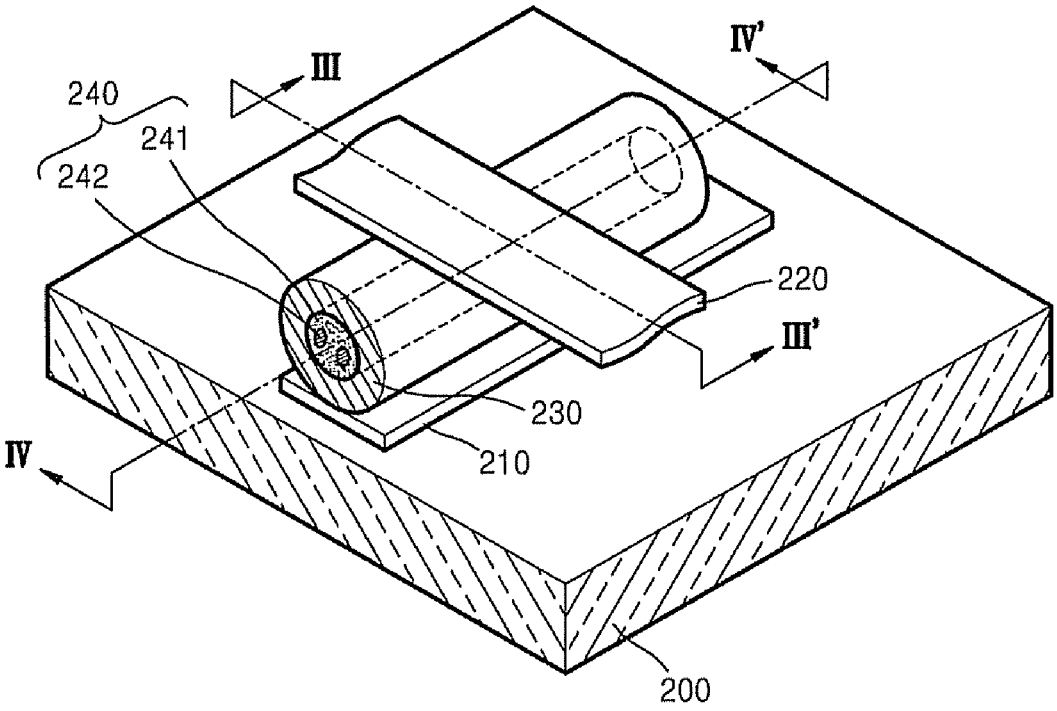
FIG. 2 is a perspective view of an exemplary embodiment of a distribution type inorganic electroluminescence device according to the invention.
Figure 3:
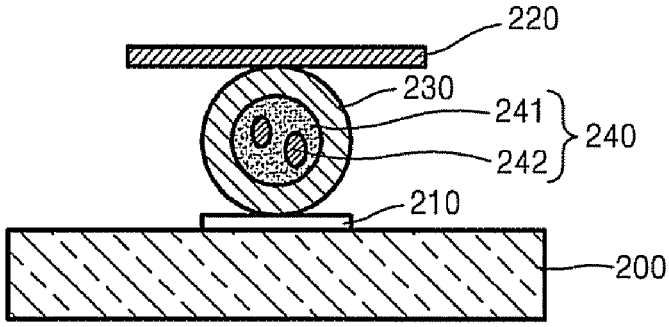
FIG. 3 is a cross-sectional view along line III-III' of FIG. 2.

FIG. 2 is a perspective view of an exemplary embodiment of a distribution type inorganic electroluminescence device according to the invention. FIG. 3 is a cross-sectional view along line III-III' of FIG. 2, and FIG. 4 is a cross-sectional view along line IV-IV' of FIG. 2.

Figure 4:
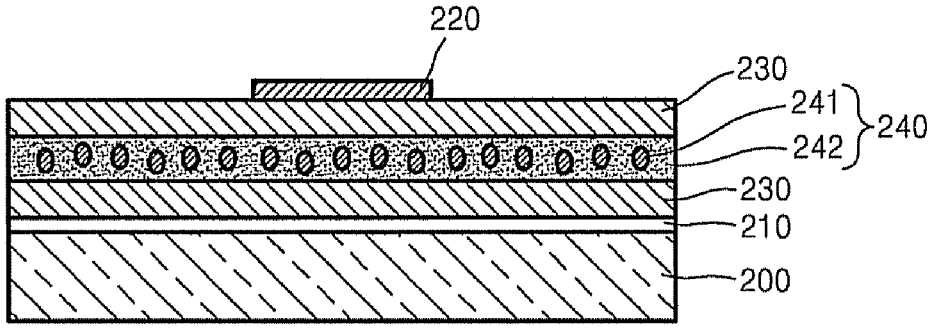
FIG. 4 is a cross-sectional view along line IV-IV' of FIG. 2.

Referring to FIGS. 2 through 4, a first electrode 210 is disposed on a substrate 200. The substrate 200 may be a transparent substrate, e.g., a glass substrate or a plastic substrate. Furthermore, the first electrode 210 may include a transparent conductive material, e.g., indium tin oxide ("ITO"). However, the invention is not limited thereto.

A dielectric material layer 230 having a micro-tubular shape, is disposed on the first electrode 210. A longitudinal extension direction of the dielectric material layer 230 may be substantially parallel to a longitudinal extension direction the first electrode 210. In FIG. 2, the dielectric material layer 230 is considered overlapping and aligned with the first electrode 210. An outer diameter of the dielectric material layer 230 may be from approximately 1 μm to approximately 10 μm, and an inner diameter of the dielectric material layer 230 may be from approximately 0.3 μm to approximately 3 μm. However, the invention is not limited thereto. The dielectric material layer 230 may include silicon oxide, for example.

The term "micro-tubular shape" is used herein to indicate a hollow, substantially cylindrical body. The body has a thickness defined by an outer diameter of the body minus the inner diameter of the body, and the thickness may be a single continuous unitary indivisible member. The micro-tubular shape of the invention include a cylindrical shaped thickness of material, and a cylindrical shaped area of the "hollow" portion where no material of the micro-tubular shape is disposed. The term "cylinder" is commonly defined as having a surface or solid bounded by two parallel planes and generated by a straight line moving parallel to the given planes and tracing a curve bounded by the planes and lying in a plane perpendicular or oblique to the given planes.

Furthermore, a light emitting layer 240 is disposed within the inner diameter of the dielectric material layer 230, and effectively completely fills an inner area of the dielectric material layer 230 having the micro-tubular shape. The inner area of the dielectric material layer 230 at the inner diameter, may be essentially rod-shaped. The light emitting layer 240 may have a thickness (e.g., outer diameter) from approximately 0.3 μm to approximately 3 μm. The light emitting layer 240 is exposed only at surfaces of ends of the rod-shaped member, while outer surfaces of a remainder of the rod-shaped member is completely surrounded (e.g., overlapped) by the dielectric material layer 230. The rod-shaped light emitting layer 240 may be a single continuous unitary indivisible member.

The light emitting layer 240 includes an insulative binder 241, and phosphor particles 242 of a color that are distributed within the insulative binder 241. Each of the phosphor particles 242 may have a diameter smaller than or equal to 1 μm. The light emitting layer 240 emits light of a color as electrons accelerated by an electric field formed in the light emitting layer 240, collide against the phosphor particles 242 distributed within the insulative binder 241.

A second electrode 220 is disposed on the micro-tubular dielectric material layer 230, and opposing the first electrode 210 with respect to the micro-tubular dielectric material layer 230. The second electrode 220 may be disposed crossing the first electrode 210 in a plan view of the distribution type inorganic electroluminescence device. A longitudinal extension direction of the second electrode 220 is inclined with respect to the longitudinal extension direction of the first electrode 210. In one exemplary embodiment, the second electrode 220 may perpendicularly cross the first electrode 210. The second electrode 220 may include a metal, e.g., silver (Ag). However, the invention is not limited thereto. Although the micro-tubular dielectric material layer 230 and the first electrode 210 are disposed substantially parallel to each other as described above, the invention is not limited thereto, and the longitudinal extension direction of the dielectric material layer 230 may be parallel to the longitudinal extension direction of the second electrode 220. In the exemplary embodiment, the micro-tubular dielectric material layer 230 is disposed longitudinally parallel with one of the first electrode 210 and the second electrode 220.

In the exemplary embodiment of the inorganic electroluminescence device having the above described structure, when a voltage is applied between the first electrode 210 and the second electrode 220, electrons are emitted from the micro-tubular dielectric material layer 230 into the light emitting layer 240. During this process, an alternating voltage may be applied between the first and second electrodes 210 and 220. However, the invention is not limited thereto, and a direct voltage may be applied between the first and second electrodes 210 and 220. The electrons emitted from the dielectric material layer 230 into the light emitting layer 240 are subsequently accelerated by an electric field formed in the light emitting layer 240, and collide against the phosphor particles 242 distributed within the insulative binder 241. Thus, light of a color is emitted from the light emitting layer 240.

Accordingly, a distribution type inorganic electroluminescence device having a definite threshold voltage may be embodied by forming the dielectric material layer 230 to have a micro-tubular shape, and disposing the light emitting layer 240 in an area of the dielectric material layer 230 to effectively fill the area of the dielectric material layer 230, according to the illustrated exemplary embodiment of the invention.

Figure 5:
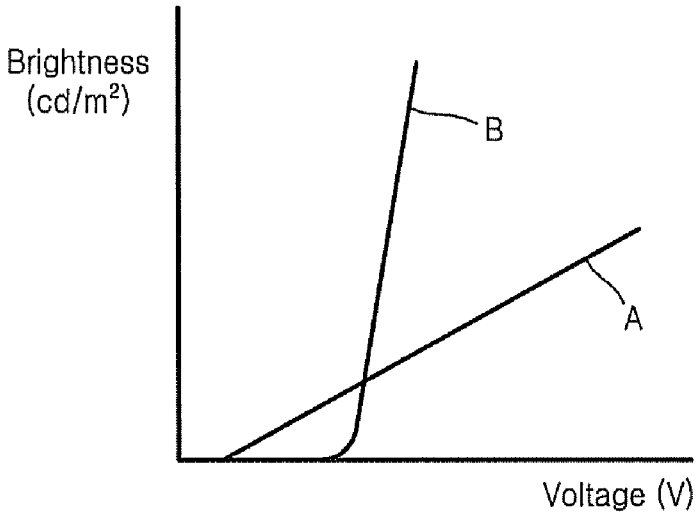
FIG. 5 is a graph illustrating a comparison of the brightness-voltage ("B-V") characteristic of the conventional distribution type inorganic electroluminescence device shown in FIG. 1, and the B-V characteristic of the distribution type inorganic electroluminescence device according to the exemplary embodiment in FIGS. 2-4.

FIG. 5 is a graph illustrating a comparison of a brightness-voltage ("B-V") characteristic of the conventional distribution type inorganic electroluminescence device shown in FIG. 1, and the B-V characteristic of the distribution type inorganic electroluminescence device according to the exemplary embodiment in FIGS. 2-4. In FIG. 5, the brightness is expressed in units of candela per square meter (cd/m$^2$), and voltage is expressed in units of volt (V).

Curve A indicates the B-V characteristic of the conventional distribution type inorganic electroluminescence device, where the thickness of the dielectric material layer 130 in FIG. 1 is 30 μm, and the thickness of the light emitting layer 140 in FIG. 1 is 50 μm. Also, curve B indicates the B-V characteristic of the distribution type inorganic electroluminescence device according to the exemplary embodiment in FIGS. 2-4, where the thickness of the dielectric material layer 230 in FIG. 2 (e.g., the outer diameter of the dielectric material layer 230 minus the inner diameter of the dielectric material layer 230) is 2 μm, and the outer diameter of the light emitting layer 240 in FIG. 2 (e.g., the inner diameter of the dielectric material layer) is 2 μm.

Referring to FIG. 5, the conventional distribution type inorganic electroluminescence device has no definite threshold voltage, because the B-V characteristic (curve A) has a gentle slope. Thus, when such a conventional distribution type inorganic electroluminescence device is used in a passive matrix ("PM") type display device, pixels which surround driven pixels that emit light, also emit light. In other words, cross-talk may occur.

In contrast, the B-V characteristic (curve B) of the distribution type inorganic electroluminescence device according to the exemplary embodiment in FIGS. 2-4 has a steeper slope than the conventional distribution type inorganic electroluminescence device (curve A), and thus the distribution type inorganic electroluminescence device according to the illustrated exemplary embodiment may have definite threshold voltage. Therefore, when a distribution type inorganic electroluminescence device according to the illustrated exemplary embodiment is used in a PM type display apparatus, a PM type display apparatus capable of reducing or effectively preventing cross-talk may be embodied.

Figure 6:
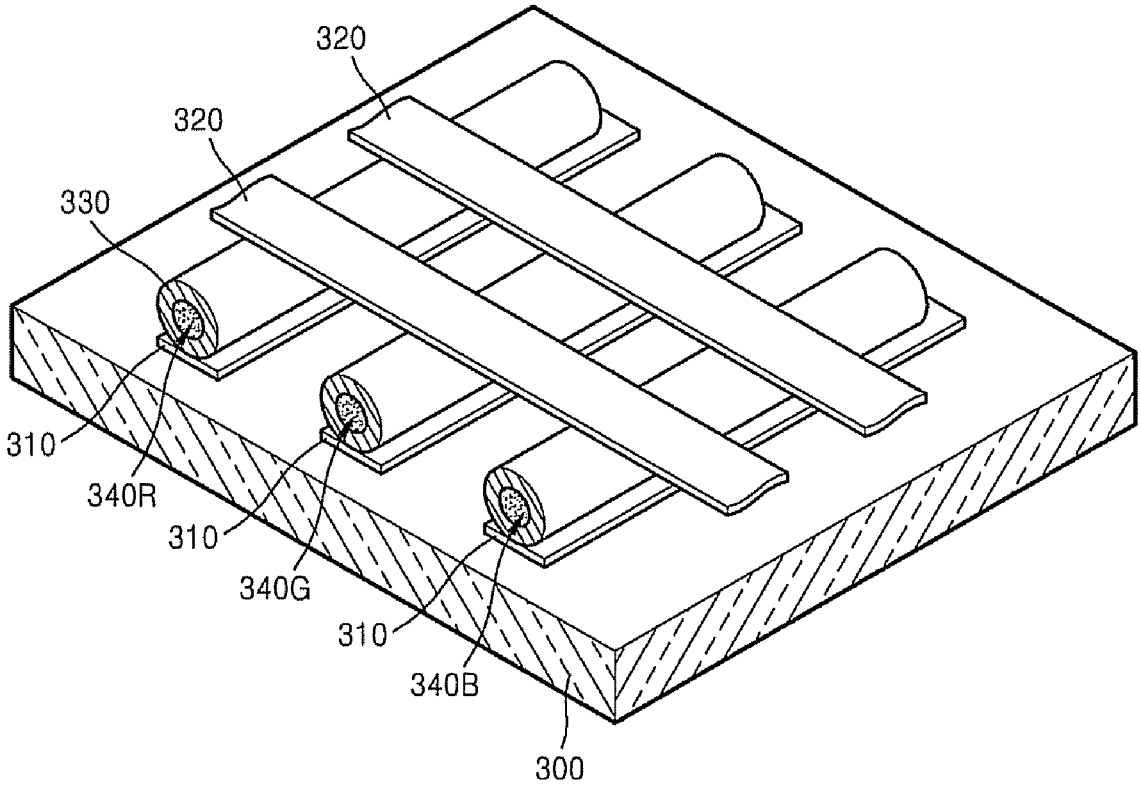
FIG. 6 is a perspective view of an exemplary embodiment of a passive matrix ("PM") type display apparatus employing a distribution type inorganic electroluminescence device, according to the embodiment in FIGS. 2-4.

FIG. 6 is a perspective view of an exemplary embodiment of a PM type display apparatus employing a distribution type inorganic electroluminescence device according to the embodiment in FIGS. 2-4.

Referring to FIG. 6, a plurality of a first electrode 310 is disposed on a substrate 300. The substrate 300 may be a transparent substrate, e.g., a glass substrate or a plastic substrate. The first electrodes 310 may be disposed in parallel to each other. In one exemplary embodiment, the first electrodes 310 may be arranged in a striped pattern on an upper surface of the substrate 300, as illustrated in FIG. 6. The first electrodes 310 may include a transparent conductive material, e.g., ITO. However, the invention is not limited thereto.

A plurality of a dielectric material layer 330 is disposed on the first electrodes 310, respectively. As described above, each of the dielectric material layers 330 has a micro-tubular shape. A longitudinal extension direction of the dielectric material layers 330 may be disposed parallel to a longitudinal extension direction of the first electrodes 310. Each of the micro-tubular dielectric material layers 330 may have an outer diameter from approximately 1 μm to approximately 10 μm, and may have an inner diameter from approximately 0.3 μm to approximately 3 μm. However, the invention is not limited thereto. Furthermore, the dielectric material layers 330 may include silicon oxide, for example.

Light emitting layers of colors, e.g., a red light emitting layer 340R, a green light emitting layer 340G, and a blue light emitting layer 340B, are disposed in the micro-tubular dielectric material layers 330. Each of the light emitting layers 340R, 340G, and 340B may have an outer diameter from approximately 0.3 μm to approximately 3 μm. As described above, each of the light emitting layers 340R, 340G, and 340B includes an insulative binder and phosphor particles of a color distributed within the insulative binder. The phosphor particles may have a diameter smaller than or equal to 1 μm.

In one exemplary embodiment, the red light emitting layer 340R may include red phosphor particles emitting red light, the green light emitting layer 340G may include green phosphor particles emitting green light, and the blue light emitting layer 340B may include blue phosphor particles emitting blue light. The red phosphor particles may include ZnS:Cu,Cl,Mn, the green phosphor particles may include ZnS:Cu,Al, and the blue phosphor particles may include ZnS:Cu,Cl, for example. However, these are just examples, and the phosphor particles may include other materials.

A plurality of a second electrode 320 is disposed on the micro-tubular dielectric material layers 330. The second electrodes 320 may be disposed crossing the first electrodes 310 in a plan view of the PM type display apparatus employing the distribution type inorganic electroluminescence device. In one exemplary embodiment, each of the second electrodes 320 may perpendicularly cross the first electrodes 310. The second electrodes 320 may include a metal, e.g., silver (Ag). However, the invention is not limited thereto. Although the micro-tubular dielectric material layers 330 and the first electrodes 310 are disposed parallel to each other as described above, the invention is not limited thereto, and the dielectric material layers 330 may be disposed parallel to the second electrodes 320 and inclined with respect to the first electrodes 310.

In the display apparatus including the above described structure, when a voltage is applied to first and second electrodes 310 and 320, the dielectric material layer 330 emits electrons into the light emitting layers 340R, 340G, and 340B. In an exemplary embodiment, the dielectric material layer 330 may be located at a pixel disposed where the first electrode 310 and the second electrode 320 to which the voltage is applied cross each other. The emitted electrons are accelerated by electric fields formed in the light emitting layers 340R, 340G, and 340B and collide against phosphor particles of colors. As a result, lights of colors, e.g., red light, green light, and blue light, are emitted from the light emitting layers 340R, 340G, and 340B, and thus an image is formed.

As described above, according to the one or more of the exemplary embodiments, each of the dielectric material layers 330 has a micro-tubular shape, and the light emitting layers 340R, 340G, and 340B of colors are disposed in the dielectric material layers 330. Thus, cross-talk, that is, unwanted emission of light emission from pixels surrounding driven pixels, may be reduced or effectively prevented.

According to one or more of the exemplary embodiments, a distribution type inorganic electroluminescence device having a definite threshold voltage may be fabricated by disposing a light emitting layer in a micro-tubular dielectric material layer, and thus a display apparatus capable of reducing or effectively preventing cross-talk may be embodied by using the inorganic electroluminescence device.

It should be understood that the exemplary embodiments described herein should be considered in a descriptive sense only and not for purposes of limitation. Descriptions of features or aspects within each embodiment should typically be considered as available for other similar features or aspects in other embodiments.

What is claimed is:

1. An inorganic electroluminescence device comprising:

a first electrode and a second electrode disposed apart from each other in a first direction;

a dielectric material layer disposed between the first and second electrodes, wherein the dielectric material layer has a micro-tubular shape having an outer diameter and an inner diameter; and a light emitting layer disposed within the inner diameter of the dielectric material layer.

2. The inorganic electroluminescence device of claim 1, wherein the light emitting layer comprises an insulative binder and phosphor particles distributed within the insulative binder.

3. The inorganic electroluminescence device of claim 2, wherein each of the phosphor particles has a diameter smaller than or equal to 1 micrometer.

4. The inorganic electroluminescence device of claim 1, wherein the outer diameter of the dielectric material layer is from approximately 1 micrometer to approximately 10 micrometers.

5. The inorganic electroluminescence device of claim 1, wherein the inner diameter of the dielectric material layer is from approximately 0.3 micrometer to approximately 3 micrometers.

6. The inorganic electroluminescence device of claim 1, wherein a longitudinal direction of the micro-tubular shaped dielectric material layer is disposed parallel to a longitudinal direction of either the first electrode or the second electrode.

7. The inorganic electroluminescence device of claim 1, wherein the first electrode includes a transparent conductive material, and the second electrode includes a metal.

8. A display apparatus comprising: a plurality of first electrodes disposed in parallel to each other; a plurality of second electrodes disposed to cross the first electrodes, wherein the second electrodes respectively correspond to the first electrodes; a plurality of dielectric material layers disposed between the first electrodes and the second electrodes, wherein each of the dielectric material layers has a micro-tubular shape; and a plurality of light emitting layers respectively filled in the dielectric material layers, wherein each of the light emitting layers comprises phosphor particles of a color.

9. The display apparatus of claim 8, wherein each of the light emitting layers comprises an insulative binder and phosphor particles of a color distributed within the insulative binder.

10. The display apparatus of claim 9, wherein each of the phosphor particles has a diameter smaller than or equal to 1 micrometer.

11. The display apparatus of claim 8, wherein a longitudinal direction of the dielectric material layers are respectively disposed on the first electrodes and in parallel to a longitudinal direction of the first electrodes.

12. The display apparatus of claim 8, wherein a longitudinal direction of the dielectric material layers are respectively disposed on the second electrodes and in parallel to a longitudinal direction of the second electrodes.

13. The display apparatus of claim 8, wherein the first electrodes and the second electrodes cross each other perpendicularly.

14. The display apparatus of claim 8, wherein an outer diameter of each of the dielectric material layers is from approximately 1 micrometer to approximately 10 micrometer.

15. The display apparatus of claim 8, wherein an inner diameter of each of the dielectric material layers is from approximately 0.3 micrometer to approximately 3 micrometer.

16. The display apparatus of claim 8, wherein the first electrodes are disposed on a transparent substrate.

17. The display apparatus of claim 16, wherein the first electrodes include a transparent conductive material, and the second electrodes include a metal.

18. A method of forming an inorganic electroluminescence device, the method comprising:

disposing a first electrode and a second electrode on a base substrate, the first and second electrodes being spaced apart from each other in a direction perpendicular to the base substrate, and disposed inclined relative to each other in a plan view of the base substrate;

forming a dielectric material layer having a micro-tubular shape having an outer diameter, and an inner diameter spaced apart from the outer diameter, the forming a dielectric material layer including disposing a light emitting layer within the inner diameter of the dielectric material layer;

disposing the dielectric material layer between the first and second electrodes.

19. The method of claim 18, further comprising disposing a plurality of the first electrode parallel to each other;

disposing a plurality of the second electrode parallel to each other and substantially perpendicular to the first electrodes; and disposing a plurality of the dielectric material between the first and second electrodes, respectively, wherein each of the dielectric material layers is disposed in parallel with the first electrodes or the second electrodes.

* * * * *